United States Patent [19]

Tucker et al.

[11] 4,332,206

[45] Jun. 1, 1982

[54] AFTERBURNER FOR COMBUSTION OF STARVED-AIR COMBUSTOR FUEL GAS CONTAINING SUSPENDED SOLID FUEL AND FLY ASH

[75] Inventors: Gordon H. Tucker, Enumclaw; Robert E. Fitch, Kent, both of Wash.

[73] Assignee: The Boeing Company, Seattle, Wash.

[21] Appl. No.: 148,361

[22] Filed: May 9, 1980

[51] Int. Cl.[3] ..... F23J 15/00

[52] U.S. Cl. ..... 110/203; 110/205; 110/212; 236/15 E

[58] Field of Search ..... 110/203, 204, 205, 210–212, 110/214; 236/15 E

[56] References Cited

U.S. PATENT DOCUMENTS

| | | | |
|---|---|---|---|
| 3,164,445 | 1/1965 | Hampel | 110/212 |
| 3,243,116 | 3/1966 | Dijt et al. | 236/15 E |
| 3,369,749 | 2/1968 | Siegmund et al. | 236/15 E |
| 3,388,862 | 6/1968 | Gabrielson | 236/15 E |
| 3,727,564 | 4/1973 | Anderson et al. | 110/212 |
| 3,777,678 | 12/1973 | Lutes et al. . | |
| 3,780,676 | 12/1973 | Hazzard et al. | 110/212 |
| 3,785,305 | 1/1974 | Schrage | 110/212 |
| 3,861,334 | 1/1975 | Stockman | 110/205 |
| 4,013,023 | 3/1977 | Lombana et al. | 110/212 |
| 4,252,300 | 2/1981 | Herder | 110/212 |

*Primary Examiner*—Henry C. Yuen

*Attorney, Agent, or Firm*—Finnegan, Henderson, Farabow, Garrett & Dunner

[57] ABSTRACT

An afterburner for use as a secondary combustion chamber in a starved-air combustor system to further combust any combustible material in the combustion gas and entrained solid particle material discharge from the combustion chamber of the starved-air combustor system. The afterburner is lined with refractory and includes a diverter plate positioned transversely to the incoming flow of combustion gases. The afterburner is divided into a plurality of reaction zones, each of which has an associated reaction air supply. The diverter plate imparts a cyclonic flow to the combustion gas which is enhanced by air injected in the combustion zones. The temperature of the gas discharged from the afterburner is monitored and the flow of reaction air controlled responsive to changes in discharge gas temperature from a predetermined temperature.

9 Claims, 5 Drawing Figures

4000
3000
2000
1000
0
T-°F
CHEMICALLY CORRECT
OPERATING RANGE FOR COMBUSTER
OPERATING RANGE FOR AFTERBURNER
-40
-20
0
20
40
60
EXCESS AIR %

217
201
225
215
230
218
207
219
227
209
213
229
211
213
205
EXHAUST GAS TEMPERATURE SENSOR
203
231

AFTERBURNER FOR COMBUSTION OF STARVED-AIR COMBUSTOR FUEL GAS CONTAINING SUSPENDED SOLID FUEL AND FLY ASH

BACKGROUND OF THE INVENTION

In the last century, much of the world's energy needs have been fulfilled by hydrocarbon fuels which provided a convenient, plentiful, and inexpensive energy source. The current rising costs of such fuels and concerns over the adequacy of their supply in the future has made them a less desirable energy source and has led to an intense investigation of alternative sources of energy. The ideal alternative energy source is a fuel which is renewable, inexpensive, and plentiful, with examples of such fuels being the byproducts of wood, pulp, and paper mills, and household and commercial refuse.

The use of alternative energy sources is not problem-free, however, since there is a concern over the contents of the emissions from the combustion of such fuels as well as the environmental ramifications of acquiring and transporting the fuel and disposing of the residue of combustion.

One promising prior art device for using such alternative energy sources, while maintaining a high degree of environmental quality, is the starved-air combustor wherein the air supplied for combustion is controlled in order to control temperature conditions and the rates of combustion are controlled to consume the fuel entirely. Such starved-air combustors are capable of burning various types of fuel and producing significant amounts of heat which can be employed for any number of purposes including the production of process steam for use in manufacturing and in the generation of electricity.

Starved-air combustors, as previously known and operated, have not been entirely satisfactory in both entirely consuming the combustible elements of the fuel at high throughput while not producing noxious emissions. This problem results, in part, from the use of such starved-air combustors to burn a wide variety of fuels some of which may be non-homogeneous, e.g., household or commercial refuse. It has not been possible in the previously known starved-air combustors to tailor in a real time manner the combustion processes to the type of fuel being combusted in order to maximize the efficiency of the combustor while minimizing the generation of air pollutants. While the pollution problem can be solved to a degree by the utilization of scrubbers and other antipollution devices, such mechanisms are very expensive and their cost may militate against the use of alternative energy sources.

SUMMARY OF THE INVENTION

It is an object of the present invention to provide a starved-air combustor capable of efficiently utilizing many different types and quantities of fuel.

Another object of this invention is to provide a starved-air combustor which does not release noxious pollutants into the atmosphere.

Yet another object of this invention is to provide a starved-air combustor which is capable of combusting to a very high degree the percentage of all combustible materials provided to it as fuel.

Still another object of this invention is to provide a starved-air combustor including an afterburner receiving the hot combustion gases from the combustion chamber, for reacting the combustion gases with air, and for combusting any combustible materials entrained in the received combustion gases.

Another object of this invention is to provide a starved-air combustor including an afterburner having a plurality of combustion zones and an air supply controller for controlling the supply of reaction air to the combustion zones in accordance with the temperature of the gases discharged from the afterburner.

To achieve these objects, and in accordance with the purpose of the invention, as embodied and broadly described herein, the starved-air combustor comprises a primary combustion chamber having an inlet end for receiving fuel, the primary combustion chamber for combusting the received fuel to produce hot, combustion gases and combustion residue, the primary combustion chamber further including an outlet end for discharging the hot, combustion gases; a secondary combustion chamber having an inlet end for receiving the hot, combustion gases and an outlet end; the secondary combustion chamber for reacting the hot, combustion gases with selective amounts of air at a significant velocity to combust further any combustible materials entrained in the received hot, combustion gases to produce hot secondary combustion gases and for discharging the hot secondary combustion gases through the outlet end of the secondary combustion chamber; and means for controlling the supply of the reaction air to the secondary combustion chamber according to the temperature of the secondary combustion gases discharged from the outlet end of the secondary combustion chamber.

The accompanying drawings, which are incorporated in and constitute a part of this specification, illustrate an embodiment of the invention and, together with the description, serve to explain the principles of the invention.

DESCRIPTION OF THE PREFERRED EMBODIMENT

Figure 1:
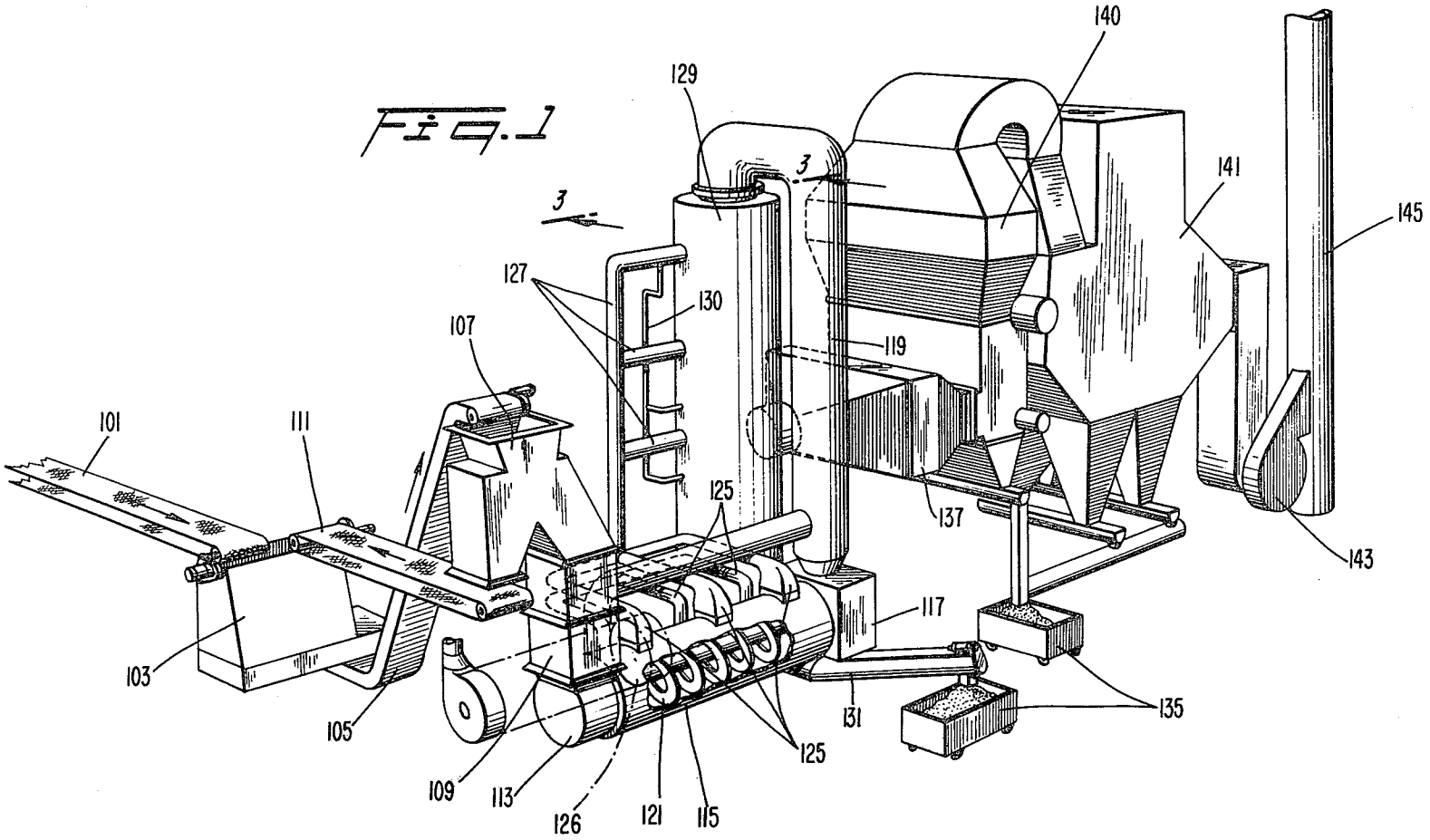
FIG. 1 is an illustration of the starved-air combustor system of the instant invention connected, for purposes of example, between a fuel supply system and a system which produces process steam from the heat produced by the starved-air combustor system.

FIG. 1 illustrates an embodiment of a starved-air combustor according to the present invention coupled between a refuse feeder system and a steam generation system. As embodied herein, the refuse supply comprises a supply conveyor 101 for conveying fuel, in this instance refuse, from a receiving building (not shown) and one or more storage silos (not shown). The receiving building and storage silos are to insure that an adequate supply of fuel can be supplied to the combustor in order to permit the combustor to run at peak efficiency. In the illustrated embodiment, it is contemplated that the supply conveyor 101 would supply fuel to the fuel surge and recirculation bin 103 at a rate of at least fifteen tons per hour and that the capacity of the combustor system would range from 150 to 500 pounds of fuel per minute.

The fuel surge and recirculation bin 103 comprises an additional means for insuring that a constant and adequate supply of fuel is available to the combustor. The bin 103 could, for example, contain at least 10 minutes capacity of fuel, i.e., approximately 2.5 tons, which is received at the top of the bin 103 and supplied through the bottom of the bin 103 to the feed conveyor 105. Feed conveyor 105 supplies the fuel to a splitter 107 which may either direct the fuel into the feed and weigh bin 109 or, when the feed and weigh bin 109 is filled to capacity, to the return conveyor 111 for return to the fuel surge and recirculation bin 103. The feed and weigh bin 109 is calibrated to supply a constant weight of fuel at the inlet end 113 of a refractory-lined combustor 115 at such time that the first flight of an auger 121 within the chamber 115 has been rotated into a fuel receiving position. Within the starved-air combustor 115 there is provided a well-known oil igniter (not shown) in the input end of the combustion chamber 115 to serve as a means for initially igniting the fuel upon start up of the starved-air combustor.

U.S. Pat. No. 4,009,667 issued to Robert C. Tyer et al on Mar. 1, 1977, illustrates an appropriate embodiment for a rotatably-driven auger comprised of a rotatable, water-cooled horizontal shaft supporting a spiral flight of decreasing pitch from the input end of the auger to the output end. It is contemplated in the instant system that the speed of the auger would range from 0.3 to 1 rpm. An appropriate oil igniter would comprise an oil burner having its flame extending into the input end of the combustor 115 to heat and to ignite the initial load of fuel supplied by the feed and weigh bin 109. It is contemplated that such an oil igniter would be capable of burning oil fuel at a rate of approximately six gallons per hour at two pounds per square inch pressure.

The combustor 115 has an output end 117 connected to a duct 119 which feeds the top of an afterburner 129. The combustor 115 also includes air supply means 123 for supplying underfire air and conduits 125 for supplying overfire air. This air is provided by a fan 126 (shown in phantom) which also supplies air through conduits 127 to the afterburner 129. Alternatively, a separate fan or fans may be provided to supply underfire air, overfire air, and air to afterburner 129. A small air distributor 130 is connected to the upper conduit 127 to supply air into the afterburner 129 through special injectors located both at and below the midpoint of the afterburner 129.

Afterburner 129 is provided, in part, as a secondary combustor chamber which mixes the air supplied by the conduits 127 with the gaseous and entrained solid particle output of the combustor from the outlet end 117 to combust all combustible material in the gaseous output and, in part, to separate suspended ash and non-combustible solids from the hot non-combustible gas. Both the non-combustible material from the afterburner 129 and the combustion residue from combustor 115 are fed through conduit 131 to an ash collector 135. The hot non-combustible gas exits into a superheater 137 from which it is supplied to a waste heat boiler 139 to produce, in this case, process steam. An electrostatic precipitator 141 removes any additional solids from the now cooler non-combustible gas exiting from the waste heat boiler 139 through a economizer 140 and the solid material is conveyed to an ash cart 135. From the precipitator 141, the non-combustible gas is drawn by a fan 143 and expelled from stack 145. Upon entering into the fan the temperature of the gas is approximately 300 to 400 degrees Fahrenheit and the fan 143 is of sufficient strength to exert a negative pressure in the system from the combustor 115, the afterburner 129, superheater 137, waste heat boiler 139, the economizer 140, and precipitator 141.

The starved-air combustion of cellulosic and carbonaceous fuel produces an off-gas which is rich in unburned gases, and in most cases, carries a substantial amount of suspended solid fuel and ash particles. The gases are typically at 1500°–2000° F. and typically have a flame temperature at complete combustion with air of 3000°–4000° F., depending upon fuel composition and mositure content. The problem arises from mixing these hot combustible gases with air and completing combustion while providing for low cost, confinement of air-fuel gas mixing and high temperature flame into a zone detached from physical surfaces of the afterburner, protection of refractory surfaces and metal surfaces from thermal loads by active air cooling, completion of combustion of solid fuel particles, and coalescence and cooling of ash to temperatures below the softening temperature before impingement on the afterburner walls, collection and removal of the ash particles which are large enough to be influenced by cyclonic flow field, mixing of air and combustion products to avoid cold/hot regions in the existing flow of combustible gases, and flame stability and control of exit temperature at variable throughput.

The prior art afterburners have not utilized advantageous gas dynamic practices to the fullest extent possible in the fact that most do not produce highly rotational flow (cyclonic) to separate the solid non-combustible particles, and do not provide for capture and removal of ash particles without operation in the ash slagging mode, thus causing build up of slag and clinkers on the afterburner surface. Also, they do not insure detachment of the flame zone from the walls of the afterburner with active air cooling of the structure.

The afterburner of the instant invention provides for an upstream component of air injection to increase the confinement of the flame zone, injection of air from the base of a diverter plate located transverse to the flow of combustion gases in the afterburner to provide for combustion on the inner surface of the flame zone, introduction of the combustion gas into the afterburner with a radial component to direct entrained particles of combustible material outward toward the combustion air, and the provision of a plurality of combustion zones in the afterburner with each zone having an independently controlled air supply.

Figure 2:
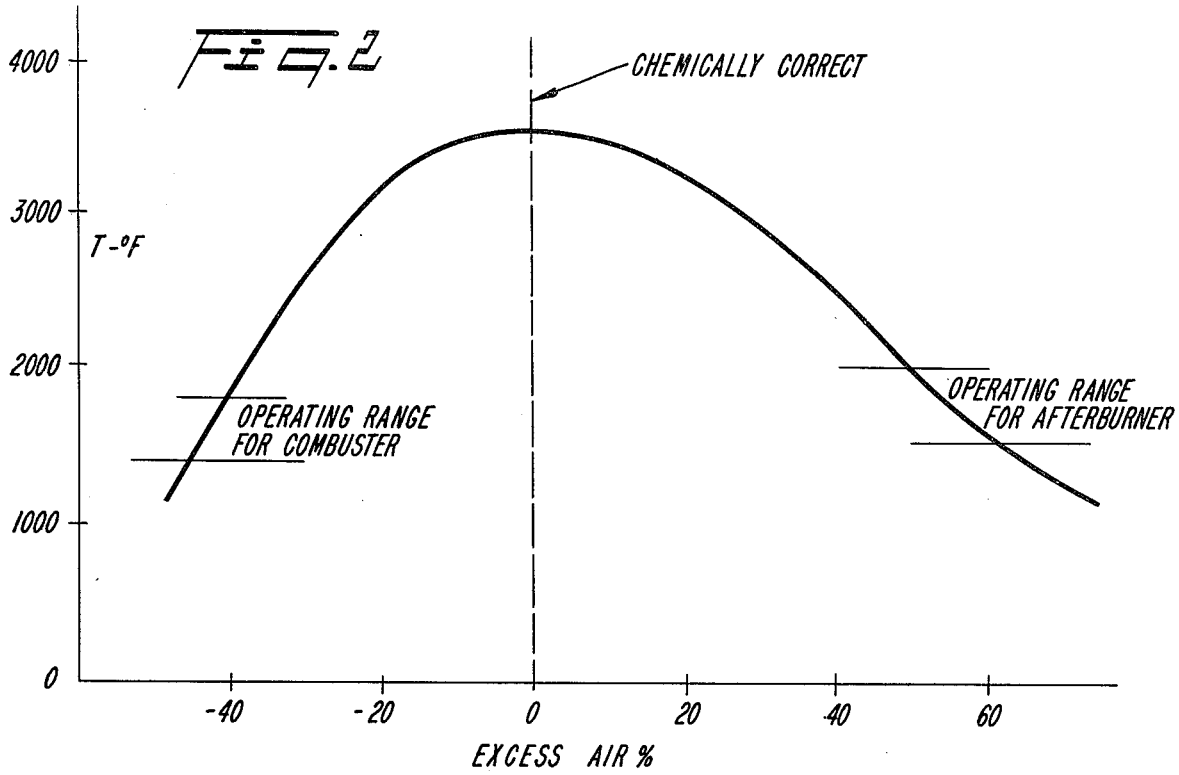
FIG. 2 is a graph illustrating the relationship between temperature in the combustion chamber and the afterburner of the starved-air combustor system as related to the amount of air supplied to the combustion chamber and to the afterburner.

The principal control difficulty in the prior art starved-air combustor systems lies in maintaining temperature levels throughout the combustor, i.e., in the combustion chamber and the afterburner, at acceptable levels while also optimizing the performance of the system. Temperature control is achieved by regulating the airflow into the combustion chamber and the afterburner to achieve the proper air/fuel ratios. FIG. 2 is a plot of temperature after reaction of fuel and air at different proportions and, as the terminology suggests, the combustion chamber of a starved-air combustor operates at a negative percentage of excess air compared to the chemically correct amount in the temperature region indicated in FIG. 2. Thus, to increase the operating temperature within the combustion chamber of a starved-air combustor, it is necessary to increase the airflow into the combustion chamber.

Also evident from FIG. 2 is that the temperature within the afterburner responds to an increase in airflow in a manner opposite to that of the combustion chamber. Thus, to increase the temperature of the combustion gases discharged from the afterburner, it is necessary to reduce the air supplied thereto.

Figure 3:
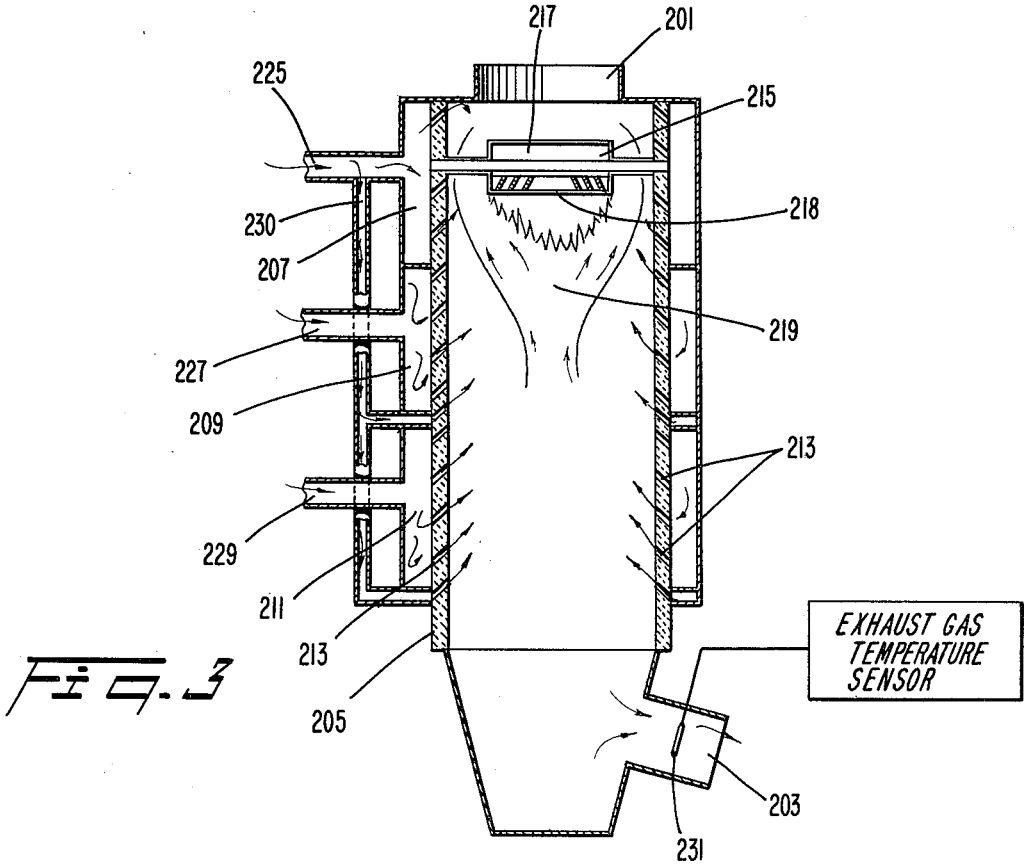
FIG. 3 is a cross-sectional view of FIG. 1 the afterburner taken along the lines 3—3.

As illustrated in FIG. 3, the afterburner of the starved-air combustor system includes an inlet end 201 for receiving the hot, combustion gases from the combustion chamber 115 and an outlet end 203 for discharging hot, secondary combustion gases from the afterburner. As stated above, it is the purpose of the afterburner to mix the hot combustion gases from the combustion chamber with air in order to combust any combustible material entrained in the combustion gases received from the combustion chamber.

The walls of the afterburner are lined with a refractory material 205 and spaced along the outside of the afterburner are air supply zones 207, 209, and 211. These zones are separate from each other and wrap completely or substantially completely around the entire external surface of the afterburner. A series of apertures or tuyures 213 are provided to enable air to be injected from the air supply zones 207, 209, and 211 into the interior of the afterburner. The tuyures 211 are directed upwardly toward the inlet end 201 of the afterburner and tangentially with respect to the inner surface of the refractory lining 205 of the afterburner. It is the purpose of the air injected by the tuyures to mix with the combustion gases received through the inlet end 201 and to facilitate a swirling pattern of the mixture while maintaining a layer of cooling air between the flame zone 219 in the afterburner and the refractory lining 205.

A diverter plate 217 is provided transverse to the flow of combustion gases into the afterburner through the inlet end 201. The diverter plate 217 receives air from the first zone 207 and includes tuyures 218 in its bottom surface to establish a flame zone in the afterburner and to initiate combustion at the underside of the flame zone 219. The hot combustion gases entering the afterburner through inlet 201 are diverted by diverter plate 215 and a swirling or cyclonic pattern is imparted to the incoming combustion gases. As mentioned above, this cyclonic or swirling action is enhanced by the flow of air from the zones 207, 209, and 211.

A conduit 230 extends from the air inlet 225 for the first zone 207 to the other zones 209 and 211 to inject air supplied to the first zone 207 through appropriate tuyures into the afterburner in zones 209 and 211. The zones 209 and 211 include their own air supply conduits 227 and 229.

The starved-air combustor also includes means for controlling the supply of reaction air to the secondary combustion chamber according to the temperature of the secondary combustion gases discharged from the outlet end 203 of the secondary combustion chamber, i.e., the afterburner. As embodied herein, part of the controlling means comprises a thermacouple 223 located in the outlet end 203 of the afterburner which provide a temperature sensor 231 with the instantaneous temperature of the secondary combustion gas exhausted through the outlet end 203 of the afterburner.

The controlling means further comprises an air supply controller associated with each zone for adjusting the supply of air to the associated zone to increase the supply of air into the plenum of the associated zone if the sensed temperature of the discharged secondary combustion gas is higher than a predetermined temperature and to decrease the supply of air into the plenum of the associated zone if the sensed temperature of the discharged secondary combustion gas is lower than a predetermined temperature.

Figure 4:
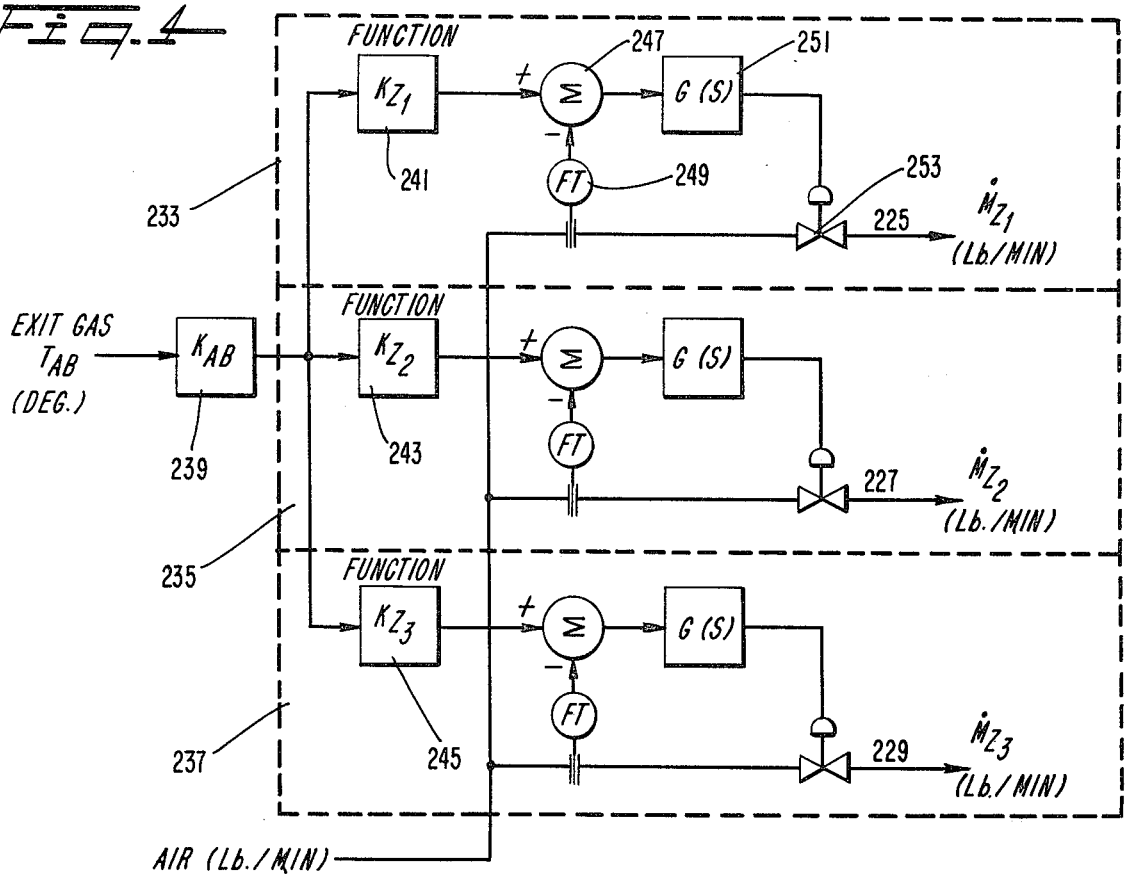
FIG. 4 is a schematic diagram of a circuit for controlling the supply of air to the afterburner of the instant invention.

FIG. 4 illustrates the air supply controller as comprising controller circuits 233, 235, and 237 corresponding to zones 207, 209, and 211. As embodied herein, the temperature from temperature sensor 231 is supplied to temperature comparater 239 wherein it is determined whether the temperature of the secondary combustion gas discharged from the secondary combustion chamber is within a predetermined temperature range. If it is not within the temperature range, then the comparator circuit 239 generates an output indicating the variance of the actual temperature from the desired temperature and this output is supplied to the function circuits 241, 243, and 245. The function circuits are initially set to apportion the airflow into the afterburner by assigning to each of the zones a percentage of the 100% of air supplied to the afterburner. As an example, it may be desired to supply 55% of the air to zone 1 of the afterburner in which case $K_{z1}$ would be equal to 55%. Similarly, $K_{z2}$ and $K_{z3}$ could be 25% and 20%, respectively.

The function circuit 241 generates an output signal corresponding to the amount of change necessary in the airflow from zone 1 in order to cause a temperature of the secondary combustion gas to be within the range of desired temperatures. This output is supplied to a summation circuit 247. The other input to summation circuit 247 is the output of flow transmitter 249 which senses the volume of air supplied to conduit 225. The summation circuit generates a signal corresponding to the difference between the desired airflow and the actual airflow and supplies that signal to the flow control circuit 251 which controls a flow control device 253, e.g., a valve, to either increase or to decrease the flow of air into the conduit 225. When a desired airflow has been reached, the output of the summation circuit 247 will be equal to zero and the flow circuit 251 will cease to adjust the flow control device 253. The operation of the circuits 235 and 237 are the same as the operation of circuit 233.

Figure 5:
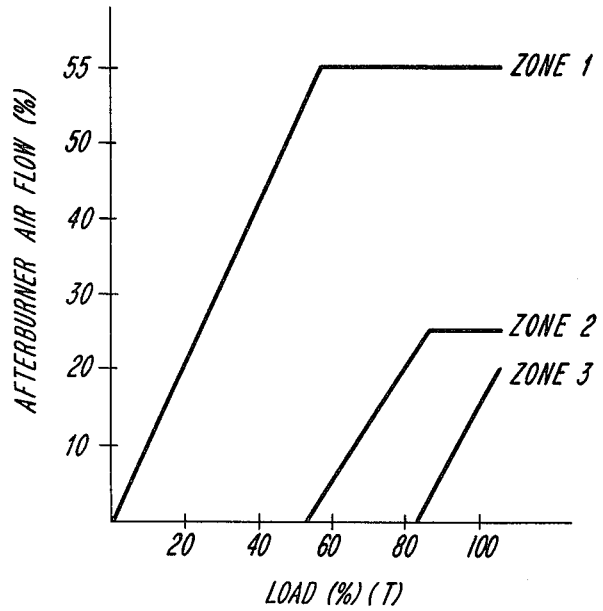
FIG. 5 is a graph illustrating the relationship between the supply of air to the zones in the afterburner to the temperature of the gases discharged from the afterburner.

FIG. 5 illustrates the manner in which the air supplies to zones 1, 2, and 3 are controlled in accordance with the load on the afterburner, i.e., the desired temperature of the secondary combustion gases discharged from the outlet 203 of the afterburner. As seen from FIG. 5, when the load is 100% of the capacity of the afterburner, 55% of the air supplied to the afterburner is provided by zone 1, 25% is provided by zone 2, and 20% is provided by zone 3. As the load decreases from 100% to just over 80%, the amount of air supplied to zone 3 is decreased from 20% down to zero percent. If the load should decrease further, then the quantity of air supplied by zone 2 is decreased from as maximum of 25% to 0% when the load is approximately 50%. Finally, the air supplied by zone 1 will be reduced from its maximum of 55% when the load drops to approximately 50%. It should be noted, that the provision of conduit 221 communicating with tuyures in the secondary and tertiary zones 209 and 211 of the afterburner causes some air to be provided to zones 2 and 3 even after the air supplied to conduits 227 and 229 has been completely cut off. This insures that there will always be a layer of high-velocity cooling air along the refractory lining 205 of the afterburner.

It will be further apparent to those skilled in the art, that various modifications and variations can be made to the afterburner to the starved-air combustor without departing from the scope or spirit of the invention and it is intended that the present invention cover the modifications and variations of the system, provided that they come within the scope of the appended claims and their equivalents.

What is claimed is:

1. A starved-air combustor comprising:

a primary combustion chamber having an inlet end for receiving fuel, said primary combustion chamber for combusting said received fuel to produce hot, combustion gases and combustion residue, said primary combustion chamber further including an outlet end for discharging said hot, combustion gases;

a secondary combustion chamber having an inlet end for receiving said hot, combustion gases and an outlet end, said secondary combustion chamber for reacting said hot, combustion gases with selective amounts of air at a significant velocity to combust further any combustible material suspended in said received hot combustion gases to produce secondary hot combustion gases and for discharging said secondary hot combustion gases through said outlet end of said secondary combustion chamber, said secondary combustion chamber including at least first and second air supply zones, each said air supply zone comprising a plenum located adjacent to said secondary combustion chamber, an air supply into said plenum, and at least one air passageway for enabling the flow of air from said plenum into said secondary combustion chamber; and means for controlling the supply of said reaction air to said secondary combustion chamber according to the temperature of said secondary combustion gases discharged from said outlet end of said secondary combustion chamber.

2. A starved-air combustor according to claim 1 wherein said secondary combustion chamber includes a deflection plate located transverse to the flow of said received hot combustion gases to impart a swirling motion to said received hot combustion gases and to establish a flame zone in said secondary combustion chamber.

3. A starved-air combustor according to claim 1 or 2 wherein said passageway directs the flow of air to increase the swirling of said received hot combustion gases and to increase the period of time said hot combustion gases are in said flame zone.

4. A starved-air combustor according to claim 3 wherein said controlling means comprises:

a temperature sensor for sensing the temperature of said discharged secondary combustion gases; and an air supply controller associated with each zone for adjusting the supply of air to said associated zone to increase the supply of air into said plenum of said associated zone if said sensed temperature of said discharged secondary combustion gas is higher than a predetermined temperature and to decrease the supply of air into said plenum of said associated zone if said sensed temperature of said discharged secondary combustion gas is lower than a predetermined temperature.

5. A starved-air combustor according to claim 4 wherein said first zone is positioned closer to said inlet end of said secondary combustion chamber than said second zone and wherein said first zone further includes a conduit for supplying a portion of the air supplied to said first zone to said second zone for injection into said secondary combustion chamber.

6. A starved-air combustor according to claim 5 wherein said air supply controller associated with said second zone adjusts the air supplied thereto in priority to said air supply controller associated with said first zone adjusting the air supplied thereto.

7. A starved-air combustor comprising:

a primary combustion chamber having an inlet end for receiving fuel, said primary combustion chamber for combusting said received fuel to produce hot, combustion gases and combustion residue, said primary combustion chamber further including an outlet end for discharging said hot, combustion gases;

a secondary combustion chamber having an inlet end for receiving said hot combustion gases and an outlet end, said secondary combustion chamber for reacting said received hot combustion gases with selective amounts of air at a significant velocity to combust further any combustible material entrained in said received hot combustion gases to produce hot secondary combustion gases and for discharging said secondary combustion gases through said outlet of said secondary combustion chamber;

a deflection plate located in said secondary combustion chamber transverse to the flow of said received combustion gases for imparting a swirling motion to said received combustion gases and to establish a flame zone in said secondary combustion chamber;

a first air supply zone located adjacent to said secondary combustion chamber proximate to said inlet end of said secondary combustion chamber, said first air supply zone including a first plenum, a first air supply to said first plenum, and a first aperture for supplying air from said first plenum to said secondary combustion chamber;

a second air supply zone located adjacent said first air supply zone, said second air supply zone including a second plenum, a second air supply to said second plenum, and a second aperture for supplying air from said second plenum to said secondary combustion chamber; and an air supply controller for sensing the temperature of said secondary combustion gases discharged from said secondary combustion chamber and for controlling the air supplied to said first plenum by said first air supply and the air supplied to said second plenum by said second air supply in a manner inversely related to the variance of said sensed temperature of said discharged secondary combustion gases from a predetermined temperature.

8. A starved-air combustor according to claim 7 wherein said first air supply zone further includes a conduit connecting said first plenum with the interior of said second air supply zone in said second combustion chamber to inject into said secondary combustion chamber through said second air supply zone a portion of the air supplied to said first air supply zone.

9. A starved-air combustor according to claim 8 wherein said air supply controller adjusts the air supplied by said second air supply zone in response to said variance of said sensed temperature of said discharged secondary combustion gases from said predetermined temperature before adjusting the air supplied by said first air supply zone.

* * * * *

UNITED STATES PATENT AND TRADEMARK OFFICE

CERTIFICATE OF CORRECTION

PATENT NO. : 4,332,206

DATED : June 1, 1982

INVENTOR(S) : Gordon H. Tucker and Robert E. Fitch

It is certified that error appears in the above—identified patent and that said Letters Patent is hereby corrected as shown below:

In the drawings, Sheet 2, Fig. 3, the arrows within the area indicated by reference numeral 219 should point in a downward direction and not an upward direction.

Signed and Sealed this

*Twenty-second* Day of *March 1983*

[SEAL]

*Attest:*

GERALD J. MOSSINGHOFF

*Attesting Officer*

*Commissioner of Patents and Trademarks*